United States Patent [19]

Schmidt et al.

[11] Patent Number: 4,503,650

[45] Date of Patent: Mar. 12, 1985

[54] GRID MAT

[75] Inventors: Gerhard Schmidt; Gerhard Ritter; Klaus Ritter, all of Graz, Austria

[73] Assignee: EVG Entwicklungs- und Verwertungs-Gesellschaft m.b.H., Graz, Austria

[21] Appl. No.: 467,379

[22] Filed: Feb. 17, 1983

[30] Foreign Application Priority Data

Feb. 17, 1982 [AT] Austria ..... 609/82

[51] Int. Cl.[3] ..... E04C 2/42

[52] U.S. Cl. ..... 52/660

[58] Field of Search ..... 52/660-667, 52/448; 206/513, 503

[56] References Cited

U.S. PATENT DOCUMENTS 1,051,126 1/1913 Lachman ..... 52/662
1,172,085 2/1916 Weakley ..... 52/448
1,740,493 12/1979 Birdsey et al. ..... 52/660
4,031,685 6/1977 Heinz ..... 206/513

FOREIGN PATENT DOCUMENTS 2350866 4/1975 Fed. Rep. of Germany .

*Primary Examiner*—James L. Ridgill, Jr.
*Attorney, Agent, or Firm*—Ernest F. Marmorek

[57] ABSTRACT

A grid mat consists of longitudinal (L) and transverse (Q) wires welded to one another, in which at least some transverse wires project beyond the longitudinal edge wires and are bent back to these in the form of loops (S).

For the purpose of space-saving stacking of the grid mats in the same way and with the same devices as used for grid mats with perfectly straight longitudinal and transverse wires, at each mat edge at least the curved parts of the loops (S) formed by the ends of the transverse wires are angled or curved out of the plane of the transverse wires (Q) so far in the direction of the plane of the longitudinal wires (L) that the arches of the loops lie between these two planes.

6 Claims, 4 Drawing Figures

GRID MAT

The invention relates to a grid mat for reinforcing concrete and consisting of longitudinal and transverse wires welded to one another, in which at least some transverse wires project beyond the longitudinal edge wires and are bent back towards the latter in the form of loops. Grid mats of this type are known, for example, from German Offenlegungsschrift No. 2 350 866. The purpose of the loop-shaped design of the end parts of the transverse wires is an improved transmission of forces from the transverse wires of one mat into the transverse wires of an adjacent mat when a surface reinforcement for a reinforced-concrete supporting framework is composed of a plurality of grid mats laid next to one another.

Since grid mats for concrete reinforcements are produced in large quantities, in a considerable number of different types and have to be kept in stock, and moreover since the ratio of the weight of steel in the grid mats to the volume required for their transport is very unfavourable, to reduce the storage and transport costs it is necessary to ensure that the mats are stacked in as space-saving a way as possible.

It has therefore been customary for a long time to stack grid mats on top of one another by means of special devices, in such a way that one mat is deposited on the stack of mats in the position in which it leaves the grid-welding machine, whereas the following mat is rotated 180° about its longitudinal axis before being deposited on the stack of mats. As a result of this measure, two mats immediately succeeding one another can arrange themselves automatically, when deposited on the stack, so that, for example, their longitudinal wires come to rest parallel to one another in the same horizontal plane and the transverse wires of the upper of these two mats likewise come to rest in the same horizontal plane as, and parallel to, the transverse wires of the next mat deposited on it. The total height of the stack of mats is thereby reduced to half the value which would be obtained if all the mats were deposited in the same orientation on the stack.

A precondition for arranging the mats in the desired way, that is to say with sets of longitudinal and transverse wires of two respective adjacent mats lying in pairs in the same plane, is a straight run of the longitudinal and transverse wires, because only if wires are straight is the probability of two wires coming to rest vertically above one another without sliding off one another extremely slight, even when both the upper wire and the lower wire are connected to other wires to form a mat.

In the known mats of this type in which the end parts of the transverse wires are bent back in the mat plane to the longitudinal wires in the form of loops stacking in the way described is not possible because the loops prevent the transverse wires of two mats lying above one another from being arranged in a common plane.

The object of the invention is to design grid mats of the type mentioned in the introduction, so that they can be stacked in a space-saving manner in the same way and with the same devices as used for grid mats with perfectly straight longitudinal and transverse wires.

According to the invention, at each mat edge at least the curved parts of the loops formed by the ends of the transverse wires are angled or curved out of the plane of the transverse wires so far in the direction of the plane of the longitudinal wires that the arches of the loops lie between these two planes. By the arch of a loop is meant, here, that point at which the tangent to the axis of the curved end part of the transverse wire runs parallel to the axes of the longitudinal wires.

As explained in more detail below with reference to the drawings, this ensures that when unrotated mats and mats rotated 180° about their longitudinal axis are deposited alternately on a stack, the angled or curved loop parts do not prevent the space-saving intermeshing of the sets of longitudinal and transverse wires of adjacent mats.

The invention will now be explained in more detail with reference to the accompanying drawings, in which.

Figure 1:
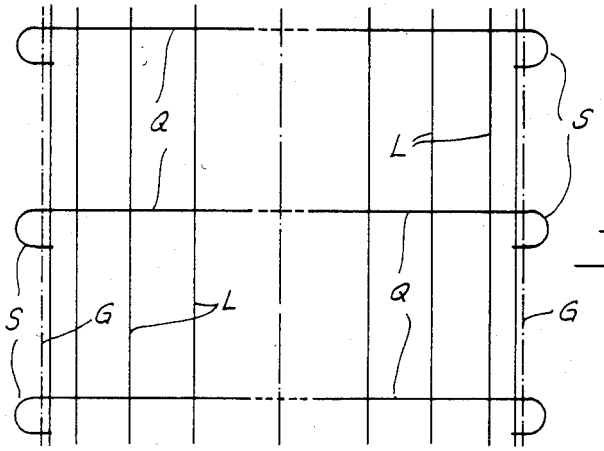
FIG. 1 shows a plan view of a grid mat according to the invention.

FIG. 1 shows a grid mat, consisting of longitudinal and transverse wires L and Q respectively welded to one another at their points of intersection, in which the end parts of the transverse wires project beyond the longitudinal edge wires and are bent back to the longitudinal edge wires in the form of loops S and are welded to them. In accordance with our earlier proposal the two outermost longitudinal wires at each mat edge have a shorter transverse distance from one another than the other longitudinal wires, in order, in the case of a supporting joint, to shorten the necessary overlap width of adjacent mats. According to the invention, the loops S are bent out of the plane of the transverse wires in the direction of the plane of the longitudinal wires around straight lines G spaced a short distance outside the longitudinal edge wires and parallel to them.

Figure 2:
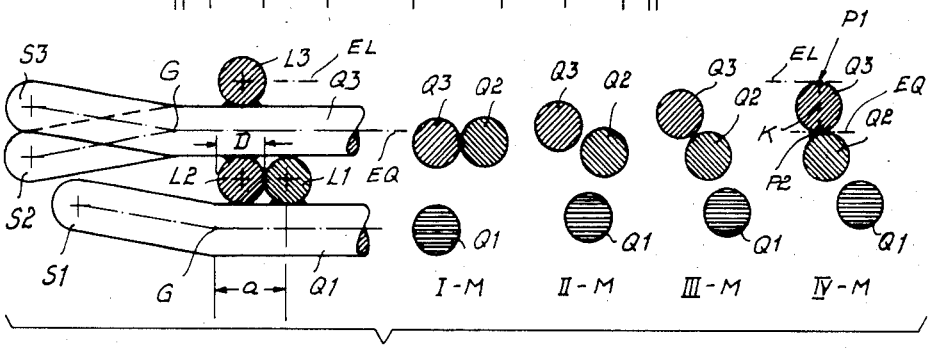
FIG. 2 shows a cross-section through one edge region of three alternately rotated and unrotated mats according to FIG. 1, stacked on top of one another.
Figure 3:
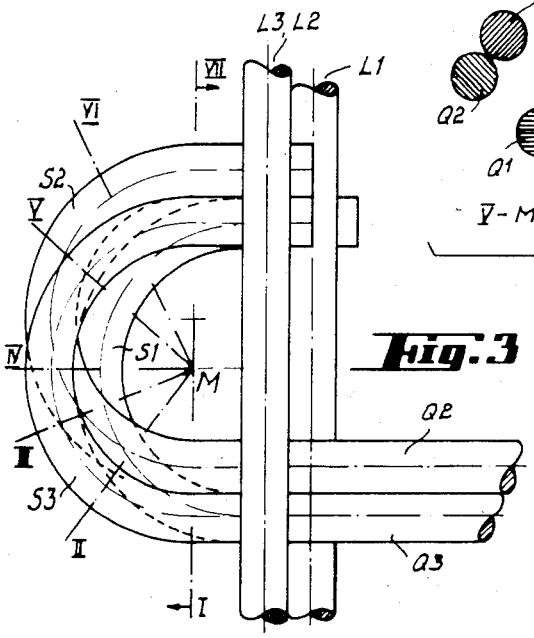
FIG. 3 shows a plan view relating to FIG. 2.

This angling of the loops S may be seen clearly in FIG. 2, which shows one edge region of three mats which are stacked on top of one another in a space-saving manner and the longitudinal wires, transverse wires and loops of which may be distinguished from one another by the indices 1, 2 and 3 added to the reference symbols L, Q and S. FIGS. 2 and 3 show a transverse wire Q1 welded to a longitudinal edge wire L1 of the lower mat, a transverse wire Q2 welded to a longitudinal edge wire L2 of the middle mat, and finally a transverse wire Q3 welded to a marginal longitudinal wire L3 of the upper mat.

The middle mat is rotated 180° relative to the lower and upper mats, as a result of which the loops S1 and S3 of the lower and upper mats, formed by the end parts of the transverse wires Q1 and Q3, appear angled obliquely upwards from the plane of the transverse wire about the straight line G represented in FIG. 2 as points, whereas the loops S2 of the middle mat appear angled obliquely downwards.

As may be seen clearly in the sectional representation of FIG. 2, the straight longitudinal wires L1 of the lower mat and L2 of the middle mat lie next to one another in a common horizontal plane, and as may be seen clearly especially in the plan view of FIG. 3, the straight parts of the transverse wires Q2 of the middle mat and Q3 of the upper mat lie next to one another in a common horizontal plane.

Figure 4:
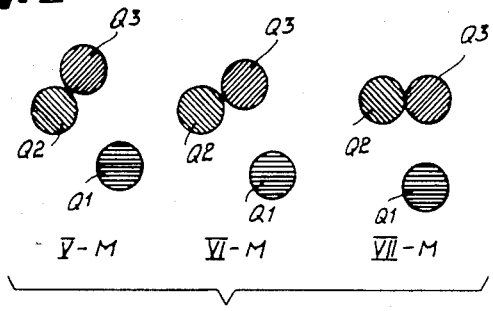
FIG. 4 shows radial sections through the end parts of the transverse wires of these mats, lying on top of one another and bent in the form of loops, along the lines I-M to VII-M in FIG. 3.

The radial sections I-M to VII-M, relating for example to the centre point M of the curvature of the loop S3, through the three loop-forming transverse wires Q1, Q2 and Q3, which are illustrated in FIG. 4, reveal that as a result of the angling of the loops the above-described space-saving intermeshing of the sets of longitudinal and transverse wires of mats adjacent to one another in pairs is not prevented. In particular, the radial sections I-M and VII-M indicate that the cross-sections of the transverse wires Q2 and Q3 lie in a common horizontal plane at the start and end of each loop, whereas according to the radial section IV-M they lie on top of one another in the region of the loop arches. In the radial section IV-M, the cross-section through the transverse wire Q3 corresponds exactly to a section through the loop arch and is denoted appropriately by K.

The straight lines G, about which the loops S are angled, are preferably at a distance, which is somewhat greater than the diameter D of the longitudinal wire, from the adjacent longitudinal edge wire of the mat, as indicated in FIG. 2 with reference to the lower mat. The transverse wires Q then extend beyond the longitudinal edge wire a further distance a in a straight line, and only the adjoining curved part of the loop is angled. As shown clearly, above all, in FIG. 2, this measure provides, in the stack, a sufficiently large free space which is limited at the top by the transverse wires Q2 and Q3 and at the bottom by the transverse wire Q1 and in which a longitudinal wire L2 of the adjacent mat can be accommodated between the loop S1 of the transverse wire Q1 and the longitudinal wire L1 welded to this transverse wire.

In the embodiment illustrated, the longitudinal and transverse wires of the grid mat have the same diameter. In this case, as shown by the radial section IV-M in FIG. 3 for the upper mat, the cross-section K through the loop arches will touch the plane EL defined by the axes of the longitudinal wires L3, and the plane EQ defined by the axes of the straight portions of the transverse wires Q3, at points P1, P2 located diametrically opposite one another on the cross-section K.

If, as occurs very frequently, the longitudinal wires have a larger diameter than the transverse wires, unimpeded space-saving stacking of the mats is still possible if the cross-sections K through the loop arches, in the radial section IV-M of FIG. 4, assume any position between the two planes EL and EQ, and, if appropriate, they can touch one of these planes, but preferably lie in the middle of these two planes.

To produce mats according to the invention, straight transverse wires can be fed to a grid-welding machine, and the end parts of these, which project beyond the longitudinal edge wires, after the welding of the longitudinal and transverse wires, are shaped in a subsequent operation into loops which are then angled or curved in a further operation in the way already described.

Alternatively, preformed transverse wires already provided with loops can be fed to the grid-welding machine, and after being welded to the longitudinal wires they merely have to be angled or curved.

Finally, in a second alternative construction method, transverse wires which are already completely shaped, that is to say provided with already angled or curved loops, and which only have to be welded to the longitudinal wires can be fed to the grid-welding machine.

We claim:

1. A grid mat comprising substantially straight longitudinal wires and substantially straight transverse wires, welded to one another at their intersections, in which two substantially parallel planes are defined by the axes of said longitudinal and said transverse wires, respectively, and in which at least some of said transverse wires project beyond edge ones of said longitudinal wires and are bent back to said edge longitudinal wires in the form of loops, each of said loops having curved parts defining an arch portion having a tangent parallel to said longitudinal wires, wherein at least said curved parts of said loops are bent out of said transverse wire plane in the direction of said longitudinal wire plane such that said arch portions of said loops lie between said transverse wire plane and said longitudinal wire plane.

2. A grid mat according to claim 1, in which said longitudinal and transverse wires have the same diameter, and wherein a circular cross-section through each said loop arch is tangent to said longitudinal wire plane and to said transverse wire plane, at points located diametrically opposite one another on said circular cross-section.

3. A grid mat according to claim 1, in which said longitudinal wires have a larger diameter than said transverse wires, and wherein said circular cross-section through each said loop arch lies in the middle between said longitudinal wire plane and said transverse wire plane.

4. A grid mat according to claim 1, wherein said loops are bent out of said transverse wire plane about straight line running parallel to said longitudinal wires, each said straight line being spaced from each adjacent said edge longitudinal wire a distance greater than the diameter of said longitudinal wires.

5. A grid mat according to claim 4, in which said longitudinal and transverse wires have the same diameter, and wherein a circular cross-section through each said loop arch is tangent to said longitudinal wire plane and to said transverse wire plane, at points located diametrically opposite one another on said circular cross-section.

6. A grid mat according to claim 2, in which said longitudinal wires have a larger diameter than said transverse wires, and wherein said circular cross-section through each said loop arch lies in the middle between said longitudinal wire plane and said transverse wire plane.

* * * * *